US006281623B1

(12) United States Patent
Suzuki et al.

(10) Patent No.: US 6,281,623 B1
(45) Date of Patent: Aug. 28, 2001

(54) CORE FOR DEFLECTING YOKE

(75) Inventors: Hidekazu Suzuki; Kazuyuki Iimura, both of Funabashi; Nobuya Kashiwaba, Narashino; Yukiharu Kinoshita, Honjyo; Shinitirou Ito, Yuri-gun; Hitoshi Iwaya, Honjyo, all of (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/191,115

(22) Filed: Nov. 13, 1998

(30) Foreign Application Priority Data

Nov. 14, 1997 (JP) ..... 9-313643

(51) Int. Cl.[7] ..... H01J 29/70
(52) U.S. Cl. ..... 313/440; 313/442; 335/210
(58) Field of Search ..... 313/440, 442, 313/422, 431, 433; 335/210, 213

(56) References Cited

U.S. PATENT DOCUMENTS

| | | | | |
|---|---|---|---|---|
| 4,754,190 | * | 6/1988 | Hinotamia et al. | 313/422 |
| 5,258,734 | * | 11/1993 | Tamai et al. | 335/213 |
| 5,801,481 | * | 9/1998 | Yokota | 313/440 |
| 5,962,964 | * | 10/1999 | Sano et al. | 313/440 |
| 6,046,538 | * | 4/2000 | Hishiki et al. | 313/440 |
| 6,087,767 | * | 7/2000 | Sano et al. | 313/440 |

FOREIGN PATENT DOCUMENTS

| | | | |
|---|---|---|---|
| 0 238 056 | * | 9/1987 | (EP) . |
| 48-85030 | * | 11/1973 | (JP) . |
| 59-77762 | * | 5/1984 | (JP) . |
| 63-13243 | * | 1/1988 | (JP) . |
| 2-297842 | * | 12/1990 | (JP) . |
| 8-007781 | | 1/1996 | (JP) . |
| 8-007792 | | 1/1996 | (JP) . |
| 8-55587 | * | 2/1996 | (JP) . |
| 8-028194 | | 3/1996 | (JP) . |
| 9-306388 | | 11/1997 | (JP) . |
| 9-293468 | * | 11/1997 | (JP) . |
| 9-320492 | | 12/1997 | (JP) . |
| 10-144238 | | 5/1998 | (JP) . |
| 10-149785 | | 6/1998 | (JP) . |
| 10-154472 | | 6/1998 | (JP) . |
| 11-16517 | * | 1/1999 | (JP) . |

* cited by examiner

*Primary Examiner*—Michael H. Day
(74) *Attorney, Agent, or Firm*—Oblon, Spivak, McClelland, Maier & Neustadt, P.C.

(57) ABSTRACT

A core for a deflecting yoke for a CRT includes a first aperture at a neck portion side having a circular configuration, and a second aperture at a funnel portion side, an inner periphery of the second aperture at an edge surface thereof having two major sides and two minor sides. The major sides contain a first circular segment of which a radius is 200 mm or larger and has a radius of which a center exists off a center of the funnel portion and an amount at which the first circular segment occupies the major sides is over 50%. The minor sides contain a second circular segment of which a radius is 100 mm or larger and has a radius of which a center exists off a center of the funnel portion and an amount at which the second circular segment occupies the minor sides is over 40%. The two major sides and the minor sides are tangential to circular segments at four corners thereof.

6 Claims, 13 Drawing Sheets

| DEFLECTION COIL | HORIZONTAL SENSITIVITIY [mHA$^2$] | FUNEL-SIDE SELECTIONAL CONFIGURATION |
|---|---|---|
| COIL SHOWN IN FIG. 17 | 10.0 | ANGULAR SHAPE |
| CONVENTIONAL SADDLE COIL | 13.6~14.0 | CIRCULAR SHAPE |
| COIL SHOWN IN FIG. 4 | 12.8~13.3 | CIRCULAR SHAPE |

CORE FOR DEFLECTING YOKE

BACKGROUND OF THE INVENTION

1. Field of the Invention

The present invention relates to a core for a deflecting yoke (deflection yoke) and to a deflecting yoke (deflection yoke), which are used for a CRT (Cathode Ray Tube) and capable of enhancing a deflection sensitivity and reducing electric power consumed.

2. Description of the Prior Art

A conventional CRT is constructed of a display panel, a funnel and a neck. A core for a deflection yoke is provided covering some portions of the funnel and the neck. The deflection yoke using such a deflection yoke core deflects an electron beam emitted from an electron gun provided at the neck. In the typical deflection yoke core, configurations of neck-and funnel-side aperture edge surfaces are circular, and the deflection yoke is constructed in such a way that horizontal and vertical windings called a saddle type coil are provided on the side of an inner surface of the core.

According to, e.g., Japanese Patent Publication No.8-28194, as shown in FIGS. 1 through 3, a deflection yoke core (a round uniform slot type core) 1 of which a sectional configuration is circular includes a plurality of protruded portions 1*a* provided consecutively from a side (a neck side) with an inner surface having a small diameter toward a side (a funnel side) having a large diameter, and grooved portions 1*b* are formed between the protruded portions 1*a*. Windings (vertical and horizontal windings) 4 are, as shown in FIG. 4, disposed in the grooved portions 1*b*, thus constructing a winding structure known as a slot system. FIG. 1 is a diagram of the deflection yoke core 1 as viewed from the funnel side, FIG. 2 is a diagram of the deflection yoke core 1 as viewed from the neck side, and FIG. 3 is a diagram showing an external portion 5*a* and a sectional portion 5*b* of the deflection yoke core 1.

In the deflection yoke core disclosed in Japanese Patent Publication No.8-28194, however, a sectional configuration of the CRT on the funnel side is circular, and, in the case of using this core, a geometrical distortion property and a mis-convergence property of the deflection yoke are substantially equal to the properties in the case of a typical deflection yoke core. Therefore, despite such a main trend that a sectional configuration of the display panel of the CRT is a rectangle exhibiting an aspect ratio of 4:3 or 16:9, a configuration of a portion, fitted with the deflection yoke, of the CRT is circular in terms of a manufacturing problem, with the result that there might be a limit in terms of enhancing the deflection sensitivity of the electron beam.

Further, Japanese Patent Application Laid-Open Publication Nos.8-7781 and 8-7792 each disclose a deflection yoke core, wherein the sectional configuration is, as shown in FIG. 5, an ellipse other than the circle. Referring again to FIG. 5, an outer surface configuration of a funnel-side section is an ellipse as indicated by four circular segments ab, bc, cd, da. In particular, the circular segments ab, cd have radii R1 having the same length, of which the center is an origin O of the X- and Y-axis coordinates. The circular segments bc, da have radii R2 having the same length, of which centers are symmetrical points S. S' on the Y-axis. Herein, let P, Q be nodal points between the circular segments bc, da and the Y-axis, and there is established a relationship such as OP (OQ)<R1. A capacity of the cone portion is thereby made smaller than that of the circular core, thus reducing deflection power. Further, the outer surface configuration of the core 2 is, as shown in FIG. 5, so formed as to contain the circular segment having the maximum radius R1 of which the center is the origin O of the X- and Y-axis coordinates. With this contrivance, a conventional sintering frame 3 for the circular core, which is formed with an aperture 3*a* having the radius R1 as indicated by the broken line in FIG. 5, can be used when manufacturing the core assuming the elliptical configuration of the outer surface by sintering.

In the deflection yoke core disclosed in Japanese Patent Application Laid-Open Publication No.8-7781, however, in order to make usable the conventional sintering frame formed with the round aperture when in the sintering process, the funnel-side outer surface configuration is elliptical, and there is neither disclosed anything about an inner surface configuration thereof nor mentioned specifically an improvement of a deflection sensitivity.

SUMMARY OF THE INVENTION

It is an object of the present invention, which has been made under such circumstances, to provide a core for a deflection yoke and a deflection yoke using the deflection yoke core for attaining an enhancement of the deflection sensitivity by taking an angular structure in which a sectional configuration of the deflection yoke core is analogous to a shape of a display panel of a cathode ray tube, especially an inner periphery of a funnel-side aperture edge surface is approximately rectangular.

According to the present invention, in a core for a deflection yoke for a cathode ray tube including a rectangular display panel, an aperture edge surface on the side of the neck portion takes a circular configuration, an inner periphery of an aperture edge surface on the side of the funnel portion takes a configuration of an approximate rectangle corresponding to a configuration of the display panel, and each of sides of the approximate rectangle contains an approximately rectilinear portion. The present invention is applied particularly to the cathode ray tube having the rectangular display panel, and it is feasible to extremely effectively enhance a deflection sensitivity and reduce the electric power consumed. In this case, the inner periphery of the sectional configuration of the funnel portion in the direction substantially perpendicular to the direction from the neck portion toward the funnel portion, is also analogous to this approximate rectangle.

Further, in the deflection yoke core according to the present invention, a neck-side aperture edge surface takes a circular configuration. A plurality of protruded portions are radially provided along an inner surface, extending from the side of the neck portion to the side of the funnel portion, in which case an envelope configuration of bottom surfaces of a plurality of grooved portions formed between the plurality of protruded portions with respect to the aperture edge surface on the side of the funnel portion, is approximately rectangular corresponding to the configuration of the display panel. Each of sides of the approximate rectangle contains an approximately rectilinear portion. Even when the plurality of protruded portions are provided along the inner surface, the deflection sensitivity can be thereby effectively enhanced. The coil is disposed in the grooved portion between the protruded portions, thereby making it feasible to concentrate a magnetic flux at a high efficiency and to further enhance the deflection sensitivity.

With respect to the aperture edge surface configuration on the side of the neck portion, if the core does not include the protruded portions provided along the inner surface, and if the protruded portions do not extend to the aperture edge surface on the side of the neck portion, the inner peripheral configuration is circular. Further, if the protruded portions are formed extending to the aperture edge surface on the side of the neck portion, the envelope configuration of the bottom surfaces of the grooved portions between the protruded portions, is circular.

Moreover, the deflection yoke core may further comprise a plurality of separating protruded portions provided separately on the side of the neck portion and the side of the funnel portion. The number of the protruded portions provided on the side of the funnel portion maybe different from the number of the protruded portions provided on the side of the neck portion. Further, at least a part of the plurality of protruded portions may be non-radially provided. With these constructions, degrees of freedom of both of the winding arrangement and a coil design are increased.

It is desirable that the approximately rectilinear portion of the major side of the approximate rectangle contains a circular segment of which a radius is 200 mm or larger, preferably 300 mm or larger. It is also desirable that the approximately rectilinear portion of the minor side of the approximate rectangle contains a circular segment of which a radius is 100 mm or larger, preferably 150 mm or larger. With this contrivance, the inner peripheral configuration of the aperture edge surface on the side of the funnel portion thereby becomes more approximate to the shape of the display panel, and contributes to the enhancement of the deflection sensitivity. It is preferable that the deflection yoke core is made approximate to the shape of the display panel in terms of enhancing the deflection sensitivity, and, preferably, in the case of the display panel taking a shape of a laterally elongate rectangle, the display panel contains the rectilinear portion. It is therefore preferable that the aperture edge surface on the side of the funnel portion be composed of the rectilinear lines. If the aperture edge surface is composed of the rectilinear lines, however, a strength of the core might decline, and in addition there might arise problems in powder molding and sintering of the core. Such being the case, each side of the rectangle is, as described above, formed to have a large radius of curvature as well as being linear approximate to the rectilinear line, whereby the problems described above can be avoided. Accordingly, when the radius of each side of the rectangle increases, the effect given above decreases, and hence the approximately rectilinear portion of each side of the approximate rectangle is preferably 1000 mm or under. The rectilinearly of each side of the rectangle is thereby maintained, and a manufacturing yield of the core can be also increased.

Further, it is desirable in terms of exhibiting the effect of the present invention that a rate at which the approximately rectilinear portion occupies the major side of the approximate rectangle, be over 50% and preferably 60% or above, and a rate at which the approximately rectilinear portion occupies the minor side of the approximate rectangle, be over 40% and preferably 45% or above. The deflection sensitivity of the deflection yoke can be thereby improved.

Moreover, the minor side and the major side of the approximate rectangle are tangential to the circular segments at four corners of the approximate rectangle, whereby an arranging position of the winding can be easily adjusted when the coil is wound on the inner surface of the core.

Further, the approximately rectilinear portion of each of the sides of the approximate rectangle may be composed of a circular segment having a radius of which the center exists off the center of said neck portion. With this construction, the circular segment can have a comparatively large radius, and therefore the approximately rectilinear portion can be made approximate to the rectilinear line. In addition, the approximate rectangle can be made more approximate to the shape of the display panel.

As obvious from the description given so far, according to the present invention, the approximately rectilinear portion implies a portion that can be made approximate to the circular segment having the large radius. The approximate rectangle is composed so that each major side of the rectangle contains over 50% , preferably over 60% of the approximately rectilinear portion, each minor side thereof contains over 40% , preferably over 45% thereof, and preferably the approximate rectangle includes the circular segments at the four corners.

Further, a deflection yoke for a cathode ray tube according to the present invention comprises the above-described core, and a winding structured so that a surface configuration thereof becomes approximate to an outer surface configuration of the funnel portion. The deflection yoke having an enhanced deflection sensitivity can be thereby obtained.

Moreover, a deflection yoke for a cathode ray tube according to the present invention comprises the core provided with the plurality of protruded portions formed along the inner surface, a vertical winding disposed along a grooved portion between protruded portions, and a horizontal winding disposed on the side of the inner surface of the core. Owing to the protruded portions, the deflection sensitivity can be further enhanced. Further, the winding of the deflection coil is disposed in the grooved portion between the protruded portions, thereby making it possible to prevent a positional deviation of the winding and easily correct a mis-convergence and a geometrical distortion after the deflection yoke has been assembled.

Furthermore, according to the present invention, there is provided a core used for a deflection yoke for a cathode ray tube constructed of a rectangular display panel and including a cone portion defined as a transition portion from the funnel portion to the neck portion, in which a sectional configuration of the cone portion in a direction perpendicular to a direction from the funnel portion to the neck portion is approximately analogous to the rectangular configuration, and the deflection yoke is disposed in the vicinity of the cone portion. An aperture edge surface on the side of the neck portion takes a circular configuration. An inner periphery of an aperture edge surface on the side of the funnel portion takes an approximately rectangular configuration corresponding to the rectangle, and each of sides of the approximately rectangular configuration contains an approximate rectilinear portion. With this construction, it is feasible to provide the deflection yoke core capable being used for the cathode ray tube including the display panel taking the rectangular shape and the funnel portion of which the sectional configuration is substantially analogous to the above rectangle, and capable of enhancing the deflection sensitivity. When a ratio of a lateral length to a vertical length of the display panel is 4:3, a ratio of the major axis to the minor axis of the approximate rectangle of the inner periphery of the aperture edge surface can be set to approximately 4:3. Further, when the above aspect ratio is 16:9, the ratio of the major axis to the minor axis of the approximate rectangle of the inner periphery of the aperture edge surface can be set to about 16:9. Further, it is preferable that the sectional configuration of the cone portion of the cathode ray tube be analogous to the shape of the display panel. The sectional configuration of the cone portion is formed into a substantially analogous shape in which each side and each angular portion of the display panel configuration are rounded in the actual design in terms of manufacturing the cathode ray tube and ensuring the strength.

Furthermore, a deflection yoke according to the present invention comprises a core constructed so that an inner surface on the side of the funnel portion is disposed along the cone portion, and a winding, disposed between the inner surface of the core and the cone portion, of which a surface configuration is analogous to an outer surface configuration of the cone portion. With this construction, the deflection yoke can be adapted to the entire neck portion of the cathode ray tube including the display panel taking the rectangular shape and the funnel portion of which the sectional configuration is substantially analogous to the rectangular shape, whereby the deflection sensitivity can be further enhanced.

Moreover, in the deflection yoke core according to the present invention, when the inner surface is provided with the plurality of protruded portions, an envelope configuration of bottom surfaces of the plurality of grooved portions formed between the plurality of protruded portions is approximately rectangular corresponding to the rectangle at an aperture edge surface on the side of the funnel portion, and each of sides of the approximately rectangular configuration may contain an approximately rectilinear portion. The deflection sensitivity can be thereby further enhanced.

Moreover, a deflection yoke according to the present invention comprises a core constructed so that a funnel-side inner surface of the core including the plurality of protruded portions is disposed along the cone portion, a vertical winding disposed along the grooved portion between the protruded portions, and a horizontal winding disposed on the side of the inner surface of the core. With this construction, the deflection yoke can be adopted to the entire neck portion of the cathode ray tube including the display panel taking the rectangular shape and the funnel portion of which the sectional configuration is substantially analogous to the rectangular shape, whereby the deflection sensitivity can be further enhanced.

DETAILED DESCRIPTION OF THE PREFERRED EMBODIMENTS

Figure 1:
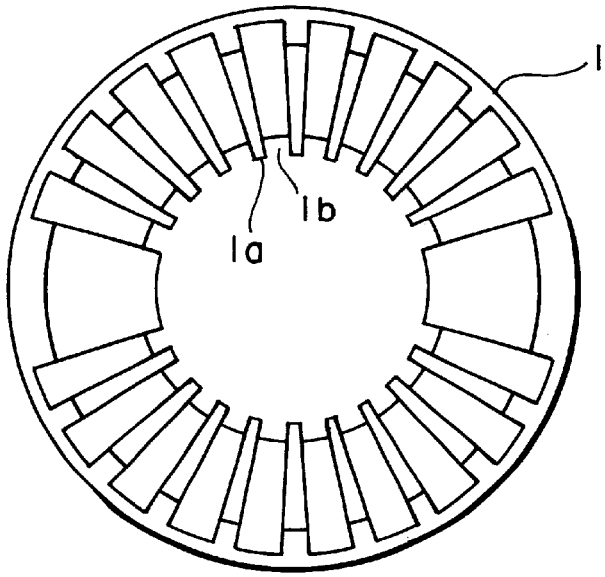
FIG. 1 PRIOR ART
FIG. 1 is a diagram of a conventional deflection yoke core as viewed from a funnel side.
Figure 2:
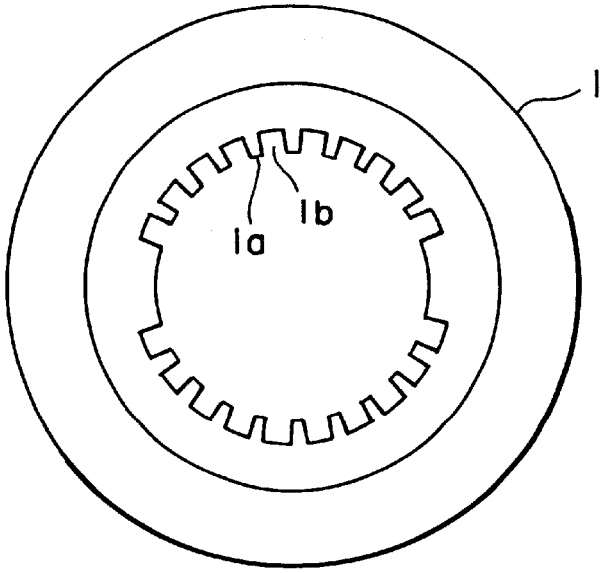
FIG. 2 PRIOR ART
FIG. 2 is a diagram of the conventional deflection yoke core in FIG. 1 as viewed from a neck side.
Figure 3:
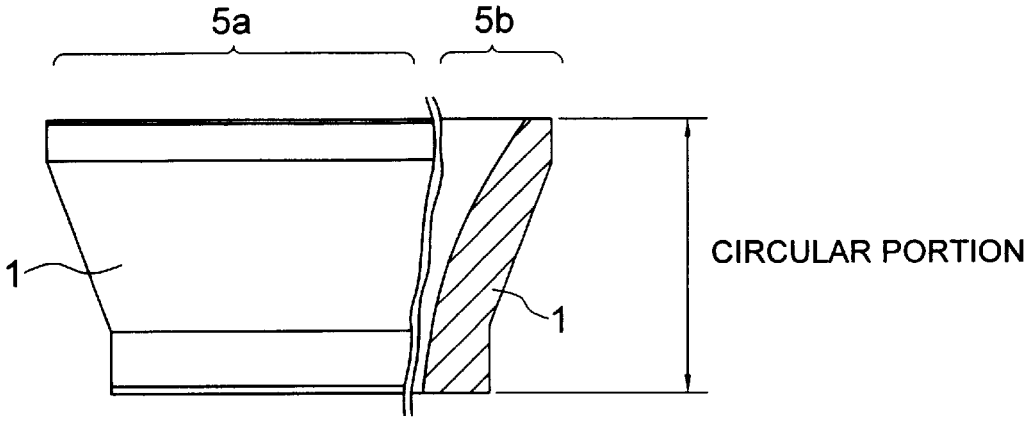
FIG. 3 PRIOR ART
FIG. 3 is a diagram showing an external portion and a sectional portion of the conventional deflection yoke core in FIG. 1.
Figure 4:
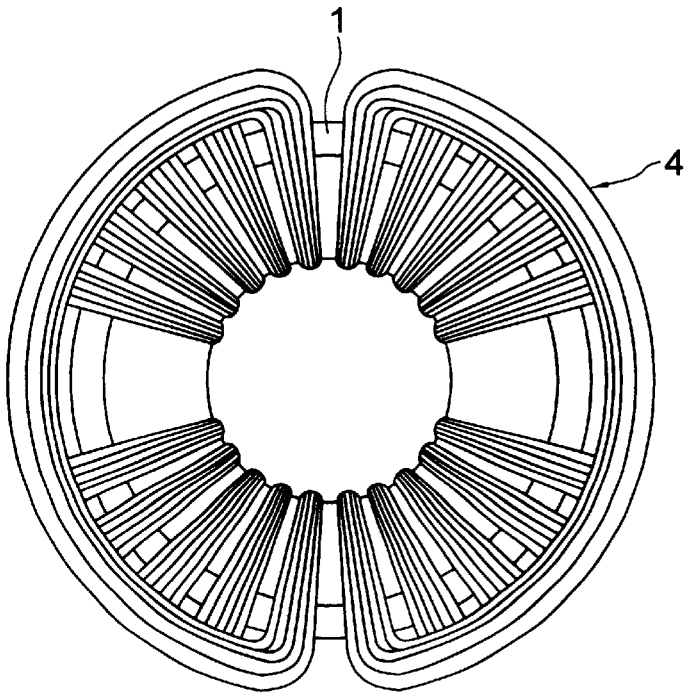
FIG. 4 PRIOR ART
FIG. 4 is a diagram showing a slot system winding structure constructed by providing the conventional yoke core shown in FIGS. 1 through 3 with a vertical winding of a deflection coil.
Figure 5:
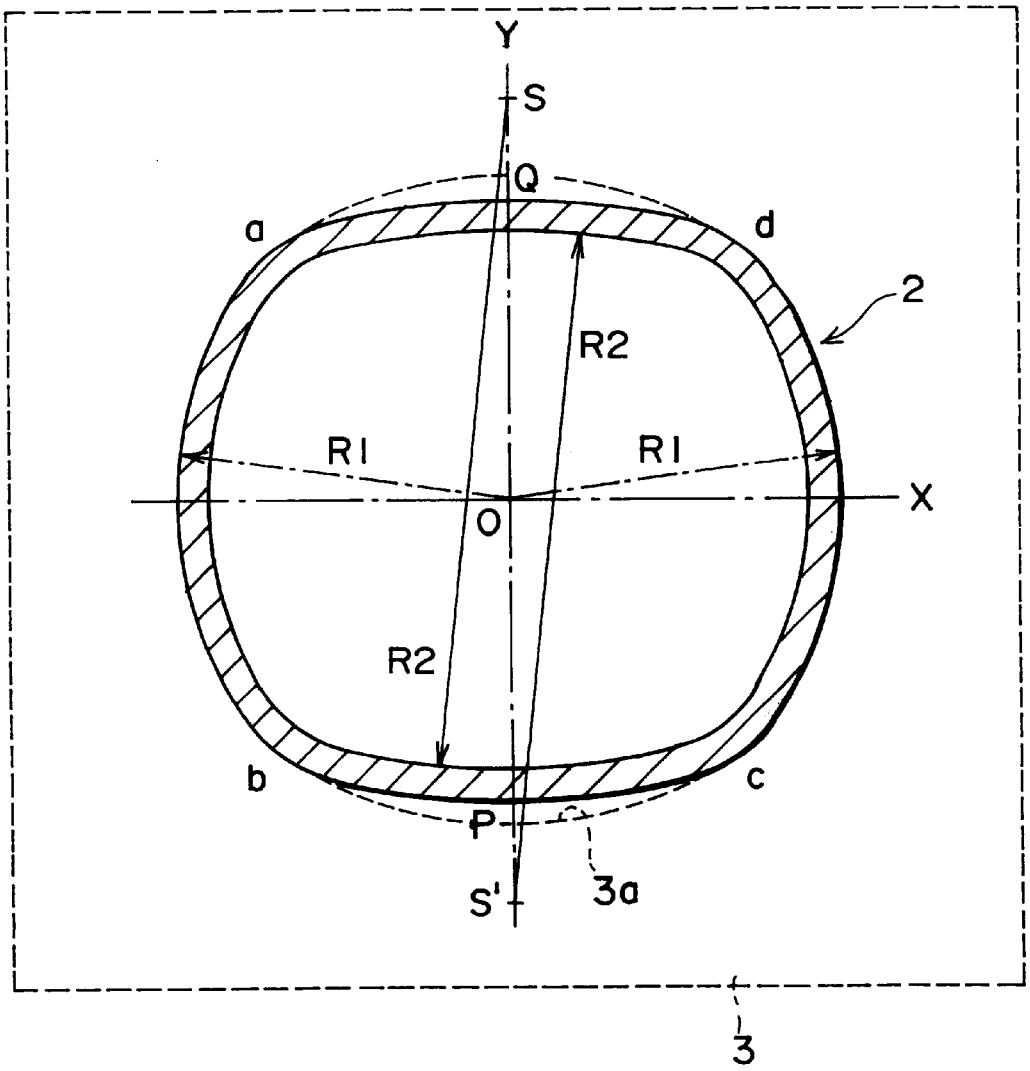
FIG. 5 PRIOR ART
FIG. 5 is an explanatory diagram showing a sectional configuration of another conventional deflection yoke core.
Figure 6:
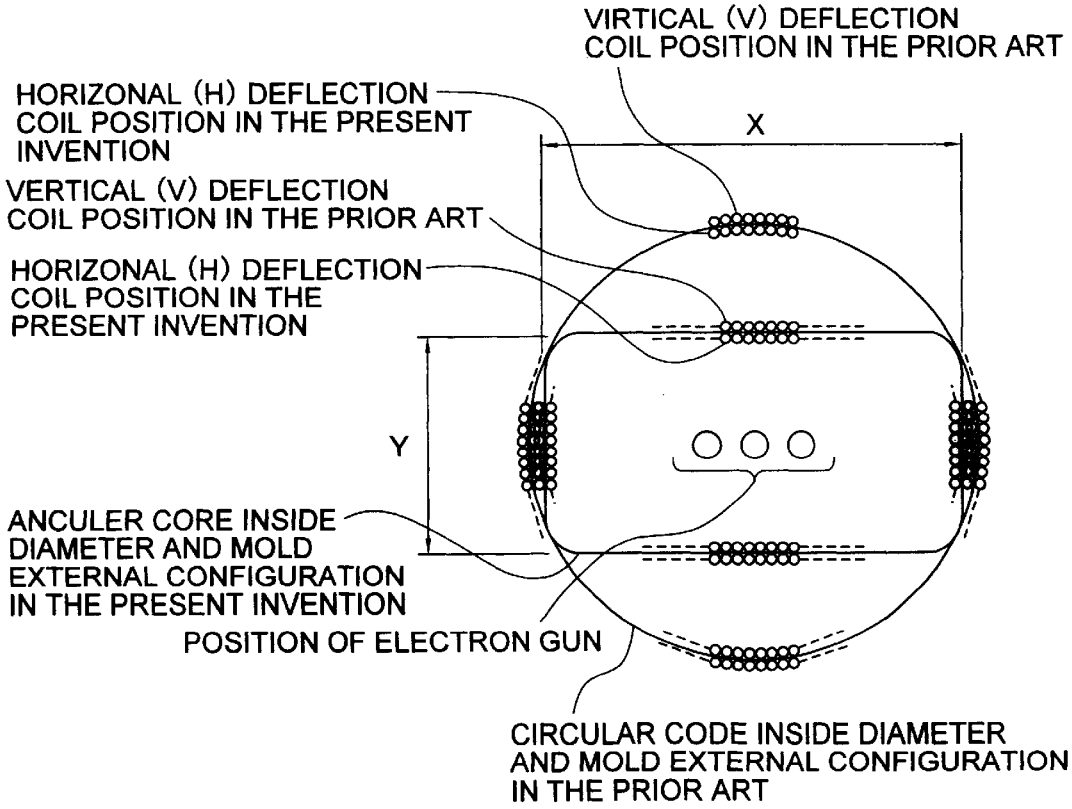
FIG. 6 is an explanatory diagram showing a comparison between a position of the winding of the deflection coil in the prior art and a position of the winding of the deflection coil in an embodiment of the present invention.

Embodiments of the present invention will hereinafter be described with reference to the accompanying drawings. FIG. 6 is an explanatory diagram showing a comparison between a winding position of a deflection coil in the prior art and a winding position of a deflection coil in the embodiment of the present invention with respect to a section in the vicinity of an edge surface of an aperture on the side of a funnel. As illustrated in FIG. 6, according to the prior art, a cone portion (a funnel portion in the vicinity of a neck portion) and a display panel of a cathode ray tube (CRT) each take a circular shape, and hence a core for a deflection yoke also assumes a circular shape in section. Accordingly, the deflection coil is provided on a circumference of the core for the deflection yoke, thereby structuring the deflection yoke.

By contrast, a sectional configuration, on the side of the funnel, of the core for the deflection yoke according to the present invention, particularly an inner periphery along an aperture edge surface thereof, is set to a shape similar to the display panel of the CRT. Namely, an angular structure (an approximately rectangular shape) is adopted, wherein a ratio of a major axis (X) to a minor axis (Y) is, e.g., approximately 16:9. With this structure, as compared with the conventional core for the deflection yoke, of which the sectional configuration is circular, the deflection coil is disposed in a position closer to the central portion of an electron gun. Accordingly, an electron beam can be deflected at a higher efficiency than by the prior art. It is therefore feasible to enhance a deflection sensitivity of the electron beam and attain a reduction in terms of a consumption of the electric power.

Next, constructions of the core fore the deflection yoke, and of the deflection yoke using this core for the deflection yoke in the embodiment of the present invention, will be explained with reference to the drawings.

<First Embodiment>

Figure 7:
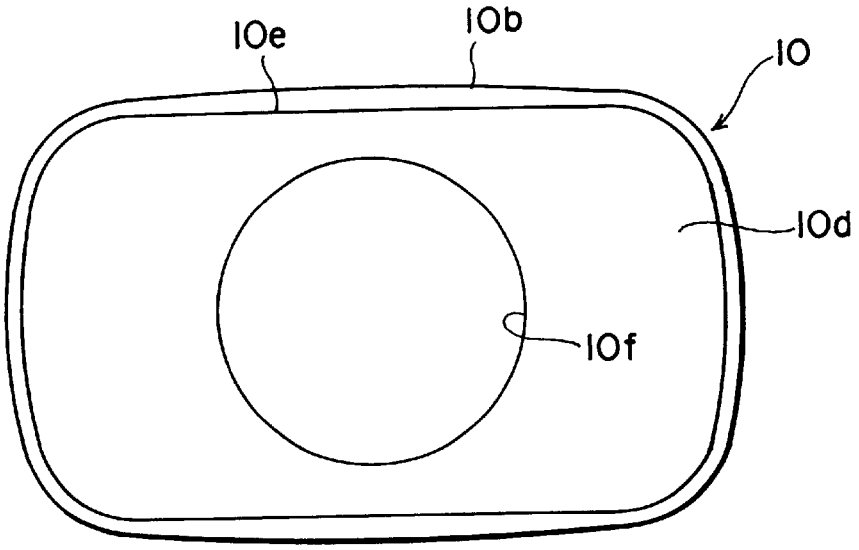
FIG. 7 is a diagram of the deflection yoke core in a first embodiment of the present invention as viewed from a funnel side.
Figure 8:
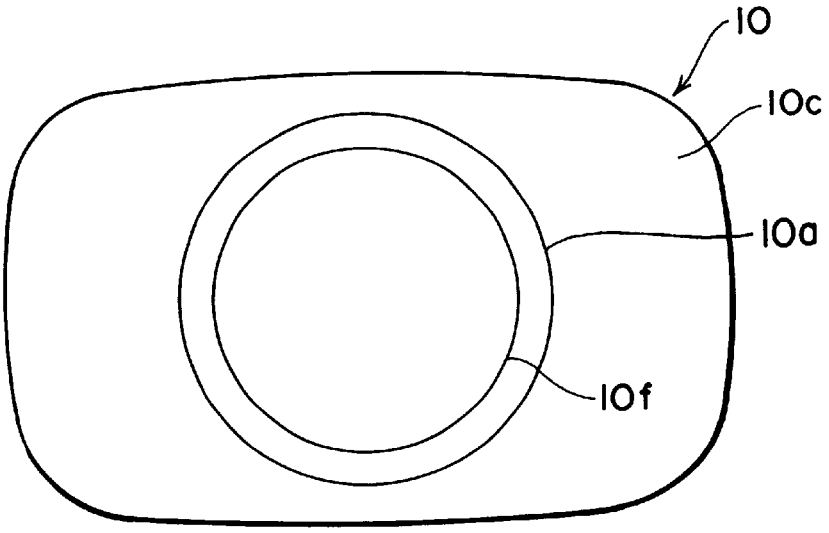
FIG. 8 is a diagram of the deflection yoke core in FIG. 7 as viewed from a neck side.
Figure 9:
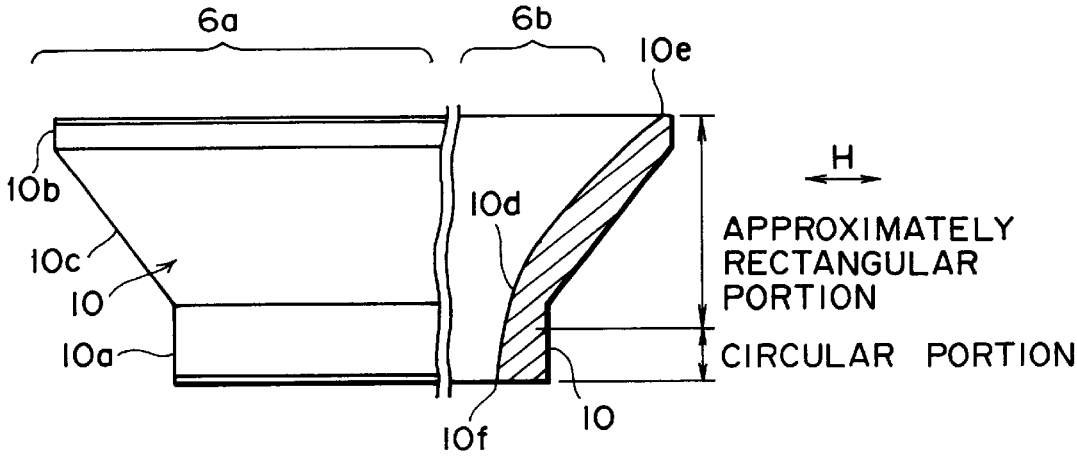
FIG. 9 is a diagram showing an external portion and a sectional portion of the deflection yoke core in FIG. 7.

FIG. 7 is a diagram showing the core for the deflection yoke, as viewed from the funnel side, in accordance with the first embodiment of the present invention. FIG. 8 is a diagram showing the core for the deflection yoke in FIG. 7, as viewed from a neck side. FIG. 9 is a diagram illustrating an external configuration 6*a* and a sectional configuration 6*b* of the core for the deflection yoke in FIG. 7.

As shown in FIGS. 7 to 9, a core 10 for the deflection yoke (which will hereinafter be simply referred to as a deflection yoke core 10) in the first embodiment is classified as an angular CR type core, and is manufactured by its being subjected to powder molding using a magnetic material such as ferrite etc and thereafter sintered. A configuration of an inner surface of a section of the deflection yoke core 10 in a direction H (FIG. 9) perpendicular to a direction from the funnel portion toward the neck portion thereof, is circular at a neck-side portion 10*a*. At a funnel-side portion 10*b*, however, the above internal surface configuration is approximately rectangular, wherein the ratio of the major axis to the minor axis is approximately 16:9. The portion 10*a* is connected via a tapered portion 10*c* to the portion 10*b*. Further, a section of the tapered portion 10*c* in the direction H takes also approximately a rectangular shape but, at the connecting portion on the neck side, gradually changes into a circular shape. Moreover, an inner periphery 10*f* of the aperture edge surface on the neck side assumes a circular configuration, and an inner periphery 10*e* of the aperture edge surface on the funnel side is approximately rectangular.

An inner surface 10*d* of the deflection yoke core 10 is flat, and the deflection coil wound on the deflection yoke core 10 has a winding structure (not shown) hitherto called a saddle-type coil, thereby constructing the deflection yoke.

Figure 22:
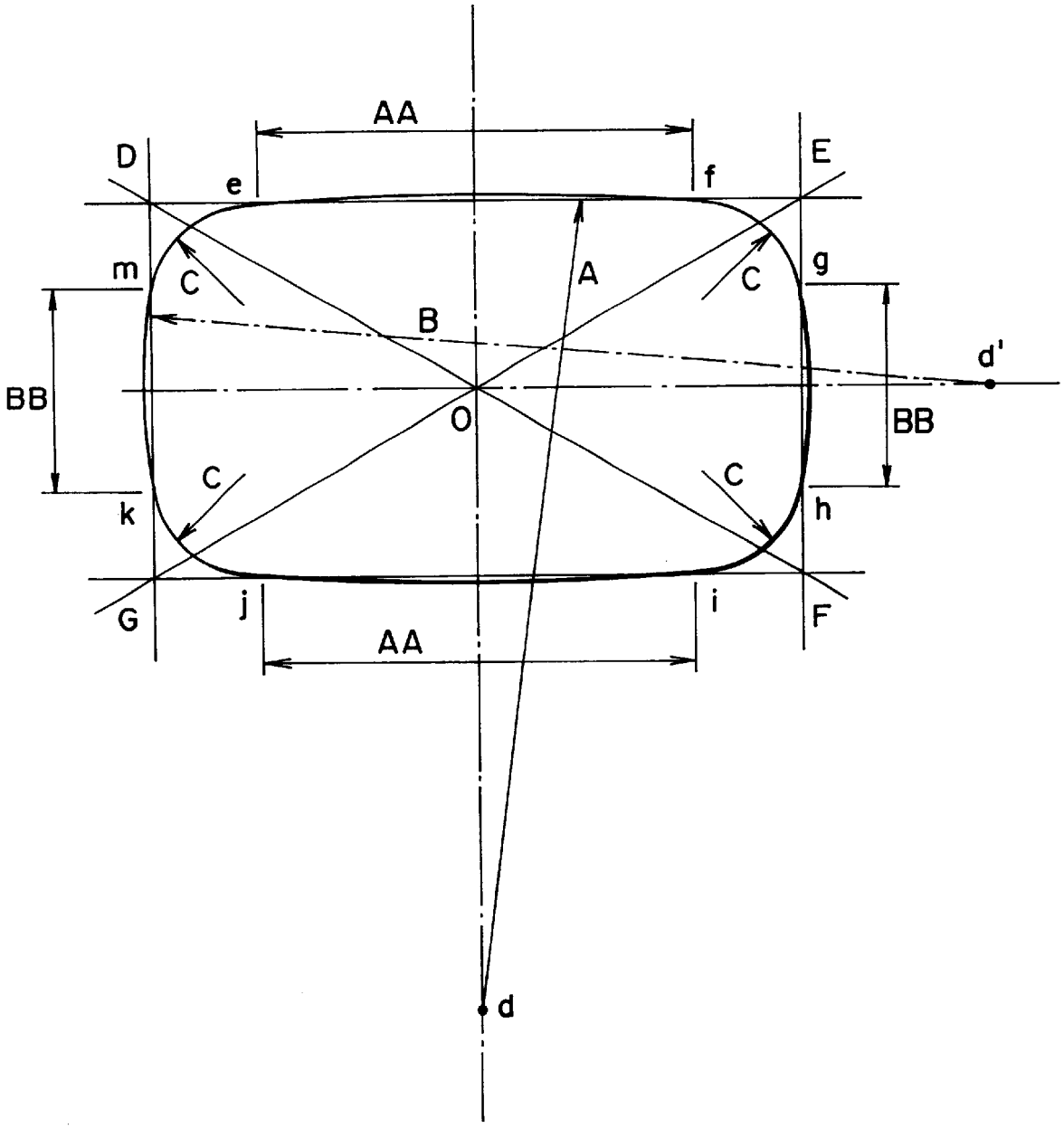
FIG. 22 is an explanatory diagram showing an approximately rectangular shape in each of the embodiments.

The approximately rectangular shape is explained referring to FIG. 22. The approximately rectangular shape formed by connecting points e, f, g, h, I, j, k and m shown in FIG. 22, corresponds to the configuration of the inner periphery 10*e* of the aperture edge surface on the funnel side in FIG. 7. The approximately rectangular shape is composed of major sides ef, ij, minor sides gh, km, and circular segments fg, hi, jk, me each having a radius c and so disposed as to be tangential to both of major and minor sides at four corners of the rectangle.

As shown in FIG. 22, the major sides ef, ij are each composed of a circular segment having a radius A (another radius on the part of the major side ij is not illustrated) with respect to a central point d positioned away from an origin O of the Y-coordinates. The radius A is, however, comparatively as large as 200 mm or more, and preferably 300 mm or more, so that the major sides ef, ij appear to be approximately rectilinear lines of which a length is AA. Further, the minor sides gh, km are each composed of a circular segment having a radius B (another radius on the part of the minor side gh is not illustrated) with respect to a central point d' positioned away from the origin O of the X-coordinates. The radius B is, however, comparatively as large as 100 mm or more, and preferably 150 mm or more, and therefore the minor sides gh, km appear to be approximately rectilinear lines of which a length is BB. Incidentally, it is desirable in terms of exhibiting effects of the present invention that the radii with respect to both of the major sides ef, ij and the minor sides gh, km be 1000 mm or under. If the radius exceeds 100 mm, the circular segment becomes extremely approximate to the rectilinear line, with the result that a core strength declines and a yield in a sintering process might be deteriorated.

Further,as shown in FIG. 22, a ratio (AA/DE) of a length DE (FG) of a major side of a rectangle DEFG containing the above approximate rectangle tangential inside thereto to a length AA of each of the approximately rectilinear lines ef and ij, is over 50%. Further, a ratio (BB/DE) of a length EF (GD) of a minor side of the rectangle to a length BB of each of the approximately rectilinear lines ef and ij, is over 40%. Moreover, each of the circular segments fg, hi, jk, me at the four corners has its center in the vicinity of diagonal lines EG, FD, and has comparatively a small radius c. That the origin O of the X- and Y-coordinates is defined as a nodal point of the diagonal lines EG, FD as well as being a radial center of the neck portion.

In the first embodiment, the configuration of the inner periphery 10*e* of the aperture edge surface on the funnel side in FIG. 7 corresponds to the approximately rectangular shape in FIG. 22 and is therefore approximate to the rectangular shape having a display panel aspect ratio of 16:9, thereby making it feasible to enhance the deflection sensitivity of the deflection yoke and reduce the electric power consumed. Further, it is normally difficult to effect the powder molding and the sintering with respect to the approximately rectilinear portions ef, ij, gh, km in the case of the rectilinear lines. Those portions are, however, composed of the circular segments, and therefore the molding process etc is easy to be executed. Besides, the above circular segment is approximate to the rectilinear line, so that the deflection sensitivity can be enhanced. Moreover, the ratio of the major side to each of the approximately rectilinear portions ef, ij is set to over 50%, and the ratio of minor side to each of the approximately rectilinear portions ef, ij is set to over 40%, whereby a convergence property of the deflection yoke can be enhanced. Moreover, the circular segments fg, hi, jk, me are formed at the four corners of the approximately rectangle, and hence the winding position can be easily controlled when the coil is wound on the inner surface of the core. The convergence property can be therefore readily controlled.

Furthermore, the configuration of the internal surface of the core on the side of the funnel is so formed as to be disposed along the cone portion of the transition from the funnel portion of the CRT to the neck portion thereof. It is therefore possible to adapt the deflection yoke to the entire neck portion of the CRT and consequently make a contribution to the enhancement of the deflection sensitivity.

<Second Embodiment>

Figure 10:
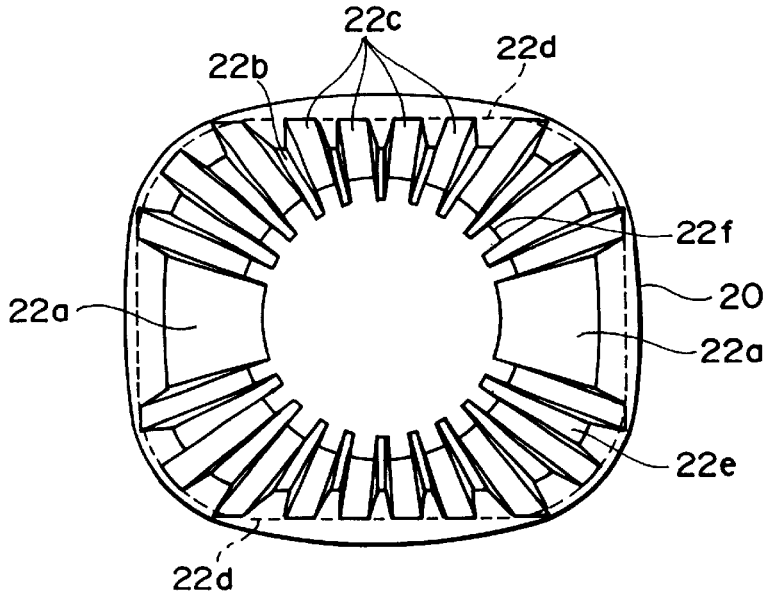
FIG. 10 is a diagram of the deflection yoke core in a second embodiment of the present invention as viewed from the funnel side.
Figure 11:
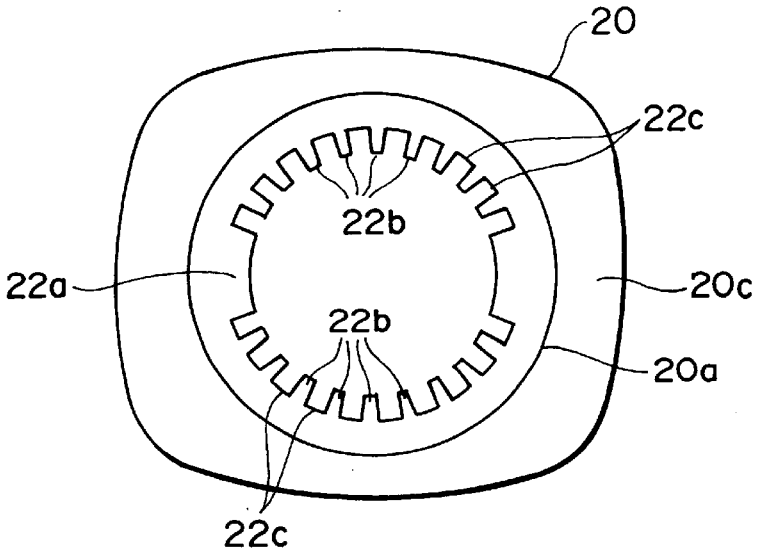
FIG. 11 is a diagram of the deflection yoke core in FIG. 10 as viewed from the neck side.
Figure 12:
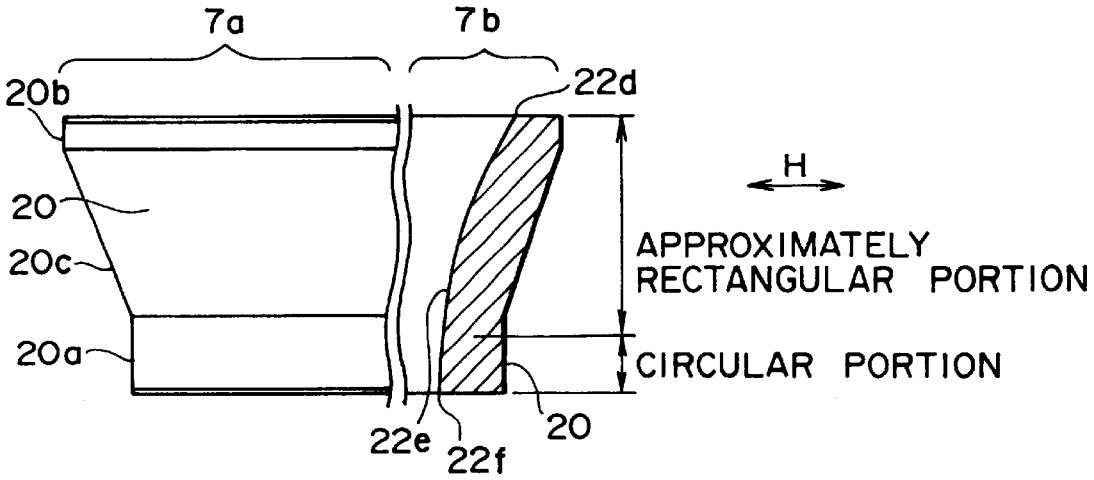
FIG. 12 is a diagram showing an external portion and a sectional portion of the deflection yoke core in FIG. 10.
Figure 13:
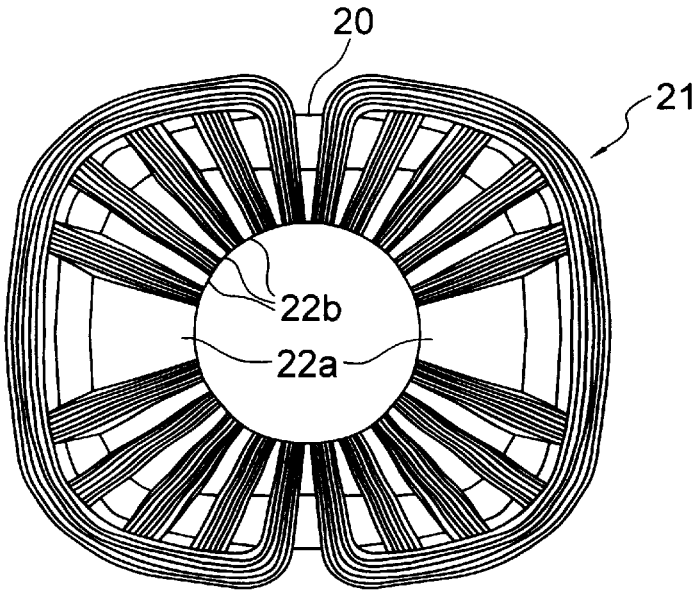
FIG. 13 is a diagram showing a winding structure of the deflection coil wound on the deflection yoke core in FIGS. 10 to 12.

FIG. 10 is a diagram showing the deflection yoke core, as viewed from the funnel side, in accordance with a second embodiment of the present invention. FIG. 11 is a diagram showing the deflection yoke core in FIG. 10, as viewed from a neck side. FIG. 12 is a diagram illustrating an external configuration 7*a* and a sectional configuration 7*b* of the deflection yoke core in FIG. 10. FIG. 13 is a diagram illustrating a winding structure of the deflection coil wound on the deflection yoke core shown in FIGS. 10 to 12.

As shown in FIGS. 10 to 13, a deflection yoke core 20 in the second embodiment is directed to an angular uniform slot type core, and is manufactured by the powder molding using a magnetic material such as ferrite etc and by the sintering. A configuration of an inner surface of a section of the deflection yoke core 20 in the direction H (FIG. 12) is circular at a neck-side portion 20*a*. An envelope configuration of a bottom surface of a grooved portion in an inner surface of a funnel-side portion 20*b* is, however, approximately rectangular, wherein a ratio of the major axis to the minor axis is about 4:3. The portion 20*a* is connected via a tapered portion 20*c* to the portion 20*b*. Further, an envelope configuration of a bottom surface of a grooved portion in the H-directional section of the tapered portion 20*c* is also approximately rectangular. Moreover, an inner periphery 22*f* of the aperture edge surface on the neck side assumes a circular configuration, and the inner surface of the connecting portion between the tapered portion 20*c* and the neck portion 20*a* gradually changes from the approximate rectangle to the circular shape.

An inner surface 22*e* of the deflection yoke core 20 is, unlike the first embodiment, provided with a plurality of protruded portions 22*a*, 22*b* radially consecutively extending toward the funnel side from the neck side. A plurality of grooved portions 22*c* are formed between the plurality of protruded portions 22*a*, 22*b*. As shown in FIG. 13, a vertical winding of the deflection coil 21 is disposed in the grooved portion 22*c* between the protruded portions 22*a* and 22*b*, while a horizontal winding thereof is disposed corresponding to the sectional configuration of the deflection yoke core 20. The deflection yoke is thus constructed. A outermost peripheral portion of the deflection coil 21 in FIG. 13 serves to connect the respective windings but does not contribute to the deflecting operation.

As illustrated in FIG. 10, a configuration of envelope lines 22*d* by which to connect, as indicated by the broken line in the same Figure, the bottom surfaces of the plurality of grooved portions 22*c* formed in the inner surface 22*e* of the core with respect to the funnel-side aperture edge surface, is approximately rectangular as illustrated in FIG. 22 (wherein an X-to-Y ratio in FIG. 6 is approximately 4:3). With this contrivance, even when the inner surface is provided with the plurality of protruded portions, the deflection sensitivity can be effectively enhanced. Further, the coil is disposed in the grooved portion between the protruded portions, whereby a magnetic flux can concentrate at a high efficiency and the deflection sensitivity can be further enhanced. Moreover, the core inner surface is formed with the plurality of protruded portions, and the winding of the deflection coil is disposed in the grooved portion between these protruded portions, in which structure a positional deviation of the winding of the deflection coil can be prevented. Further, a winding arrangement is easily adjusted, thereby facilitating corrections of a mis-convergence and of a geometrical distortion after assembling the deflection yoke.

<Third Embodiment>

Figure 14:
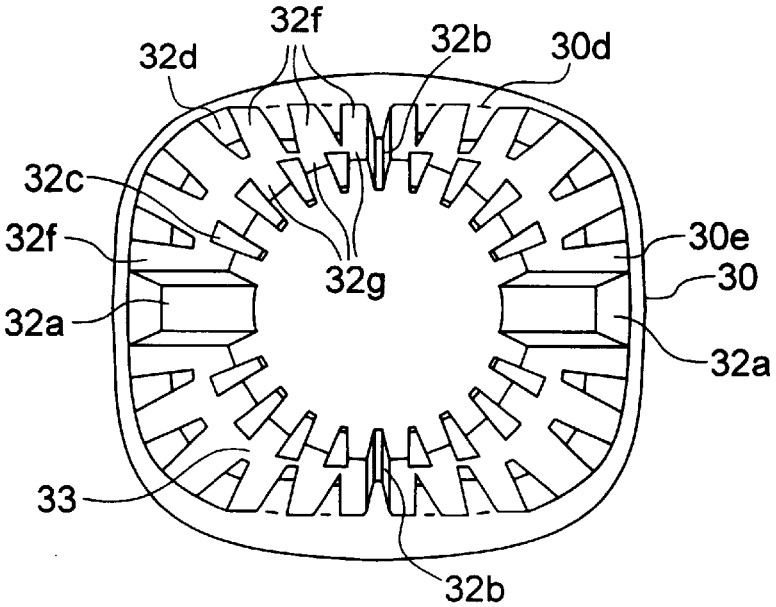
FIG. 14 is a diagram of the deflection yoke core in a third embodiment of the present invention as viewed from the funnel side.
Figure 15:
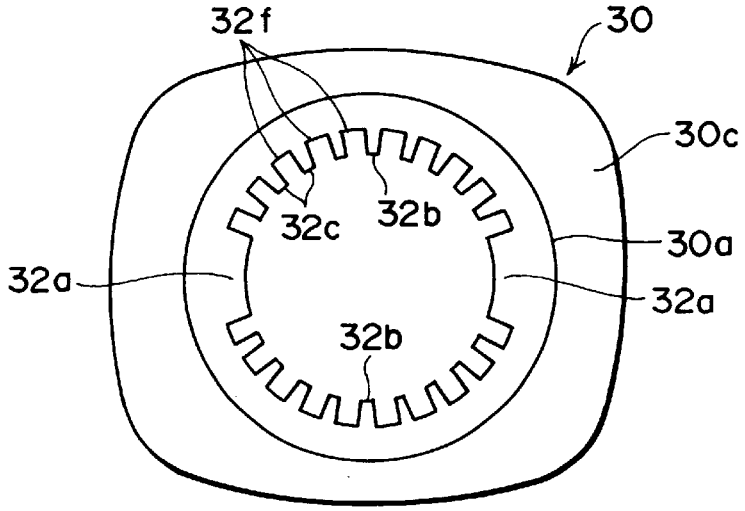
FIG. 15 is a diagram of the deflection yoke core in FIG. 14 as viewed from the neck side.
Figure 16:
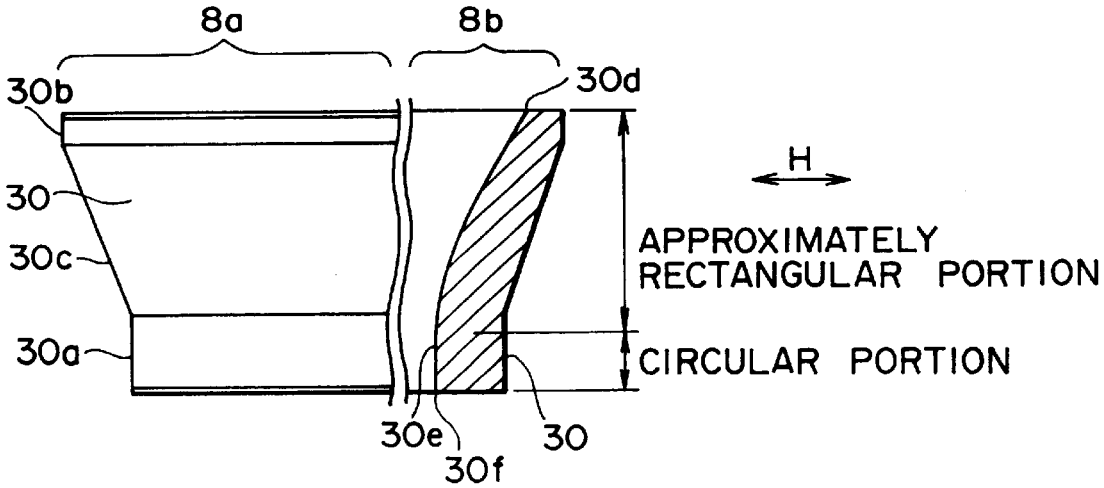
FIG. 16 is a diagram showing an external portion and a sectional portion of the deflection yoke core in FIG. 14.
Figures 17, 18:
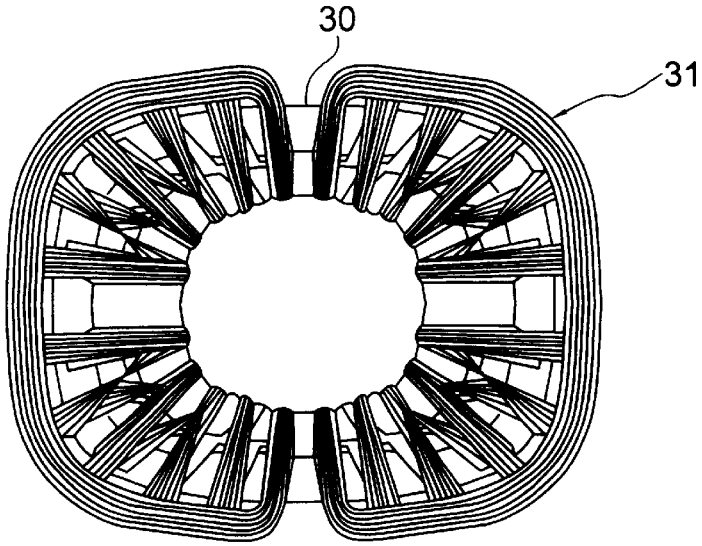
FIG. 17 is a diagram showing a winding structure of the deflection coil wound on the deflection yoke core in FIGS. 14 to 16.
FIG. 18 is a diagram showing a result of comparison between a horizontal sensitivity when using the conventional deflection coil and a horizontal sensitivity when using the deflection coil according to the present invention.

FIG. 14 is a diagram showing the deflection yoke core, as viewed from the funnel side, in accordance with a third embodiment of the present invention. FIG. 15 is a diagram showing the deflection yoke core in FIG. 14, as viewed from a neck side. FIG. 16 is a diagram illustrating an external configuration 8*a* and a sectional configuration 8*b* of the deflection yoke core in FIG. 14. FIG. 17 is a diagram illustrating a winding structure of the deflection coil wound on the deflection yoke core shown in FIGS. 14 to 16.

As shown in FIGS. 14 to 17, a deflection yoke core 30 in the third embodiment is classified as an angular teeth cut type core, and is manufactured by the powder molding using a magnetic material such as ferrite etc and by the sintering. A configuration of an inner surface of a section of the deflection yoke core 30 in the direction H (FIG. 16) is circular at a neck-side portion 30*a*. An envelope configuration of a bottom surface of a grooved portion in an inner surface of a funnel-side portion 30*b* is, however, approximately rectangular, wherein a ratio of the major axis to the minor axis is about 4:3. The portion 30*a* is connected via a tapered portion 30*c* to the portion 30*b*. Further, an envelope configuration of a bottom surface of a grooved portion in the H-directional section of the tapered portion 30*c* is also approximately rectangular. Moreover, an inner periphery 30*f* of the aperture edge surface on the neck side assumes a circular configuration, and the inner surface of the connecting portion between the tapered portion 30*c* and the neck portion 30*a* gradually changes from the approximate rectangle to the circular shape.

An inner surface 30*e* of the deflection yoke core 30 is, as in the second embodiment, provided with a plurality of protruded portions 32*a*, 32*b* radially consecutively extending toward the funnel side from the neck side. A plurality of protruded portions 32*c* are further provided on the neck side, and a plurality of protruded portions 32*d* are provided on the funnel side. A plurality of grooved portions 32*f* are formed between the plurality of protruded portions 32*a*, 32*b*, 32*d*. The number of the protruded portions 32*d* on the funnel side is over the number of the protruded portions 32*c* on the neck side. A middle portion (the tapered portion 30*c*) of the inner surface of the deflection yoke core 30 is flat.

As shown in FIG. 14, a configuration of envelope lines 30*d* by which to connect, as indicated by the broken line in the same Figure, the bottom surfaces of the plurality of grooved portions 32*f* formed on the funnel side in the inner surface 30*e* of the core with respect to the funnel-side aperture edge surface, is approximately rectangular as illustrated in FIG. 22 (wherein the X-to-Y ratio in FIG. 6 is approximately 4:3). With this contrivance, as in the second embodiment, the deflection sensitivity can be effectively enhanced. Further, the coil is disposed in the grooved portion between the protruded portions, whereby the magnetic flux can concentrate at a high efficiency and the deflection sensitivity can be further enhanced. Moreover, the winding arrangement is easy to be adjusted, and hence the mis-convergence can be easily corrected.

Incidentally, the plurality of protruded portions 32*c*, 32*d* provided in the inner surface of the deflection yoke core 30 are divided into four regions by the plurality of protruded portions 32*a*, 32*b* consecutively provided in the positions facing to each other. Namely, the protruded portions 32*a*, 32*b* are each provided by twos and disposed in the face-to-face relationship.

As illustrated in FIG. 17, the vertical winding of the deflection coil 31 is disposed through a separating portion 33 formed in a spacing between the protruded portions 32*c*, 32*d* divided above, and the horizontal winding is disposed corresponding to the sectional configuration of the deflection yoke core 30. Herein, the winding arrangement of the deflection coil 31 is adjusted in the bottom surface of the grooved portion between the protruded portions. The deflection yoke is thus constructed. An outermost peripheral portion of the deflection coil 3 in FIG. 17 serves to connect the respective windings but does not contribute to the deflecting operation.

In accordance with the third embodiment, as in the second embodiment of the present invention, it is possible to prevent the positional deviation of the winding of the deflection coil and to facilitate the corrections of the mis-convergence and of the distortion after assembling the deflection yoke. Further, the number of the protruded portions 32*d* on the funnel side is equal to or larger than the number of the protruded portions 32*c* on the neck side, and therefore a part of the vertical windings disposed in the plurality of grooved portions 32*g* between the plurality of protruded portions on the neck side, divert at the separating portions 33 and are disposed on the plurality of grooved portions 32*f* on the funnel side. Thus, the number of the protruded portions 32*d* on the funnel side differs from the number of the protruded portions 32*c* on the neck side, whereby the disposition of the vertical winding can be changed based on the funnel side and the neck side. This enables a degree of freedom of the disposition to increase, which is preferable in terms of designing the deflection yoke.

Herein, a horizontal sensitivity (the deflection sensitivity) in the case of using the prior art deflection coil is compared with a horizontal sensitivity (the deflection sensitivity) in the case of using the deflection coil in the third embodiment. FIG. 18 is a diagram showing a result of the comparison between the horizontal sensitivity in the case of using the prior art deflection coil and the horizontal sensitivity in the case of using the deflection coil shown in FIG. 17. As can be understood from the compared result shown in FIG. 18, the deflection sensitivity when using the deflection coil in the third embodiment is more improved by at least over 20% than in the case of using the prior art deflection coil.

As described above, in the deflection yoke core and the deflection yoke using the above deflection yoke core in the third embodiment, the sectional configuration of the deflection yoke core on the funnel side is set similar to the display panel of the CRT, i.e., the approximate rectangle, wherein the ratio of the major axis (X) to the minor axis (Y) is approximately 4:3 or approximately 16:9. With this contrivance, it is feasible to enhance the deflection sensitivity of the electron beam and attain improvements in the distortion property and in the mis-convergence property.

<Fourth Embodiment>

Figure 19:
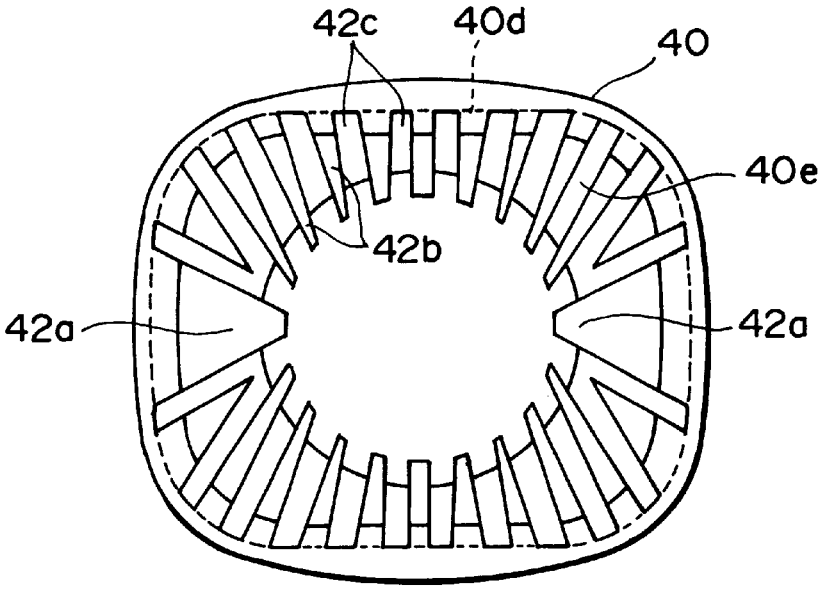
FIG. 19 is a diagram of the deflection yoke core in a fourth embodiment of the present invention as viewed from the funnel side.
Figure 20:
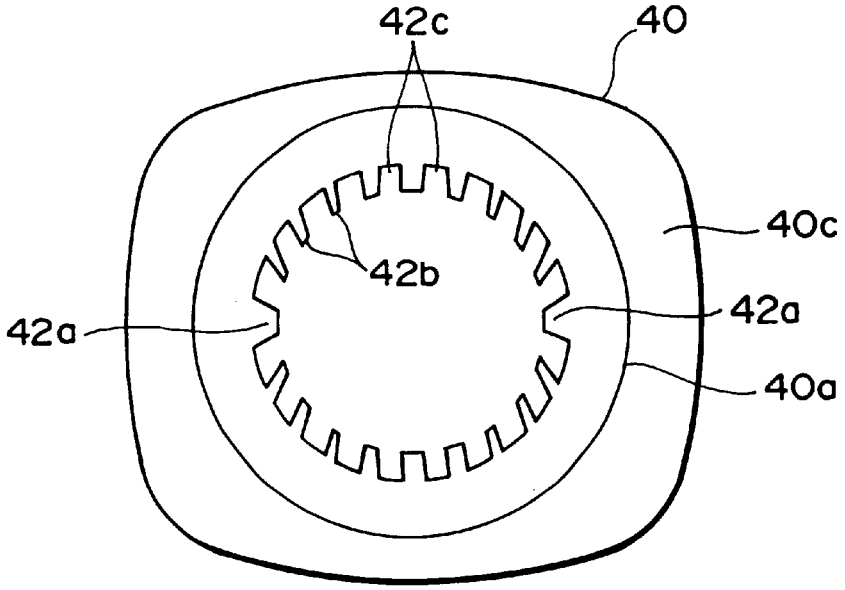
FIG. 20 is a diagram of the deflection yoke core in the fourth embodiment of the present invention as viewed from the neck side.
Figure 21:
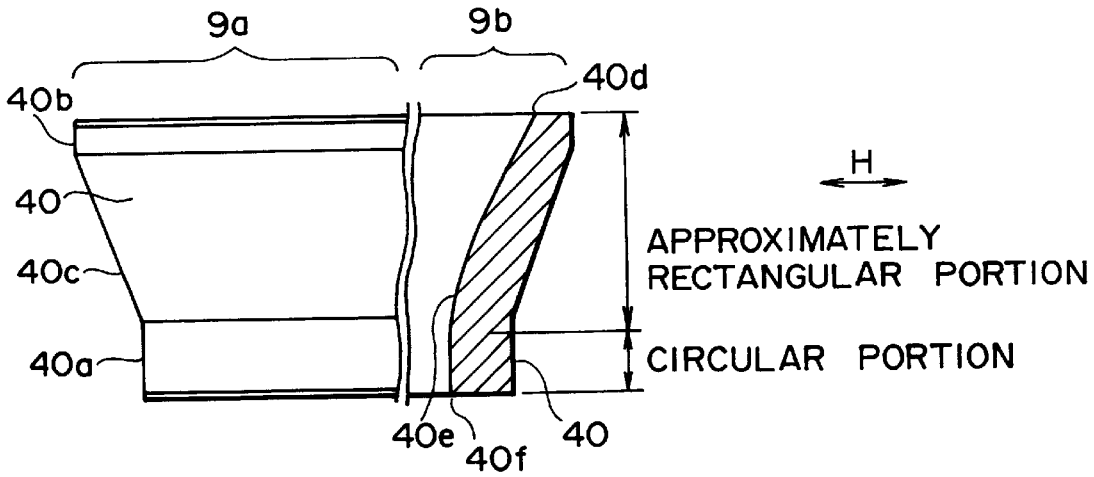
FIG. 21 is a diagram showing an external portion and a sectional portion of the deflection yoke core in FIG. 20.

FIG. 19 is a diagram showing the deflection yoke core, as viewed from the funnel side, in accordance with a fourth embodiment of the present invention. FIG. 20 is a diagram showing the deflection yoke core in FIG. 19, as viewed from a neck side. FIG. 21 is a diagram illustrating an external configuration 9*a* and a sectional configuration 9*b* of the deflection yoke core in FIG. 19.

As shown in FIGS. 19 to 21, a deflection yoke core 40 in the fourth embodiment is classified as an angular non-uniform slot type core, and is manufactured by the powder molding using a magnetic material such as ferrite etc and by the sintering. Further, a configuration of an inner surface of a section of the deflection yoke core 40 in the direction H (FIG. 21) is circular at a neck-side portion 40*a*. An envelope configuration of a bottom surface of a grooved portion in an inner surface of a funnel-side portion 40*b* is, however, approximately rectangular, wherein a ratio of the major axis to the minor axis is about 4:3. The portion 40*a* is connected via a tapered portion 40*c* to the portion 40*b*. Further, an envelope configuration of a bottom surface of a grooved portion in the H-directional section of the tapered portion 40*c* is also approximately rectangular. Moreover, an inner periphery 40*f* of the aperture edge surface on the neck side assumes a circular configuration, and the inner surface of the connecting portion between the tapered portion 40*c* and the neck portion 40*a* gradually changes from the approximate rectangle to the circular shape.

An inner surface 40*e* of the deflection yoke core 40 is provided with a plurality of protruded portions 42*a*, 42*b* non-radially consecutively extending toward the funnel side from the neck side. That is, as shown in FIG. 19, a part of the protruded portions 42*b* are formed extending toward the center on the neck side, while other protruded portions 42*b* are formed extending in a direction deviating from this center.

As illustrated in FIG. 19, a configuration of envelope lines 40*d* by which to connect, as indicated by the broken line in the same Figure, the bottom surfaces of the plurality of grooved portions 32*c* formed in the inner surface 40*e* of the core with respect to the funnel-side aperture edge surface, is approximately rectangular as illustrated in FIG. 22 (wherein the X-to-Y ratio in FIG. 6 is approximately 4:3). With this contrivance, as in the second embodiment, it is possible to effectively enhance the deflection sensitivity, efficiently concentrate the magnetic flux by disposing the coil in the grooved portion between the protruded portion, and further enhance the deflection sensitivity.

The deflection yoke core 40 is, as in the case of the deflection yoke core 30 in the third embodiment, adjustable in terms of the winding arrangement of the deflection coil. The deflection yoke is thus constructed. Accordingly, as in the second embodiment of the present invention, it is feasible to prevent the positional deviation of the winding of the deflection coil and to facilitate the corrections of the mis-convergence and of the distortion after assembling the deflection yoke. Further, the protruded portions are non-radially provided, whereby the degree of freedom of the disposing the winding of the coil can be preferably enhanced.

There have been exemplified so far the deflection yoke core and the deflection yoke using the deflection yoke core, in which the funnel-side sectional configuration and the inner periphery of the aperture edge surface are approximate rectangles with the major-axis-to-minor-axis ratios of about 4:3 and 16:9. The funnel-side sectional configuration of the conventional deflection yoke core was circular. According to the present invention, however, the sectional configuration of the deflection yoke core, particularly the envelope configuration (in the funnel-side aperture edge surface) of the bottom surface of the grooved portion between the protruded portions provided on the core inner surface, is set similar to the shape of the display panel taking the rectangle in which the CRT aspect ratio is 4:3 or 16:9, i.e., the angular structure of the approximate rectangle with the major-axis-to-minor-axis ratio of, e.g., about 4:3 and 16:9. The deflection sensitivity, the distortion property and the mis-convergence property can be thereby improved.

The ratio of the major axis to the minor axis of the approximate rectangle maybe, as a matter of course, a different value corresponding to the aspect ratio of the rectangular display panel. This makes it feasibly to similarly improve the deflection sensitivity, the distortion property and the mis-convergence property.

The core for the deflection yoke according to the present invention is applied to the deflection yoke, and the deflection yoke is applied to the CRTs of a variety of display devices. The present invention enhances the deflection sensitivity in the CRT, and is useful for reducing the electric power consumed.

What is claimed is:

1. A core for a deflection yoke for a cathode ray tube, comprising:

a first aperture at a neck portion side, said first aperture having a circular configuration;

a second aperture at a funnel portion side, an inner periphery of said second aperture at an edge surface thereof having two major sides and two minor sides;

wherein said major sides contain a first circular segment of which a radius is 200 mm or larger and has a radius of which a center exists off a center of said funnel portion, and an amount at which said first circular segment occupies the major sides, is over 50%, said minor sides contain a second circular segment of which a radius is 100 mm or larger and has a radius of which a center exists off a center of said funnel portion, and an amount at which said second circular segment occupies the minor sides, is over 40%, and said two major sides and said minor sides are tangential to circular segments at four corners thereof.

2. A deflection yoke for a cathode ray tube, comprising:

a core according to claim 1, and vertical and horizontal windings disposed on a side of an inner surface of said core and structured so that a surface configuration of said windings becomes approximate to an outer surface configuration of said funnel portion.

3. A core for a deflection yoke for a cathode ray tube, comprising:

a first aperture at a neck portion side, said first aperture having a circular configuration;

a plurality of protruded portions radially provided along an inner surface, extending from said neck portion side to a funnel portion side;

a plurality of grooved portions provided between said plurality of protruded portions;

a second aperture at the funnel portion side, an envelope configuration of bottom surfaces of said plurality of grooved portions at edge surface thereof having two major sides and two minor sides;

wherein said major sides contain a first circular segment of which a radius is 200 mm or larger and has a radius of which a center exists off a center of said funnel portion, and an amount at which said first circular segment occupies the major sides, is over 50%, said minor sides contain a second circular segment of which a radius is 100 mm or larger and has a radius of which a center exists off a center amount at which said second circular segment occupies the minor sides, is over 40%, and said two major sides and said minor sides are tangential to circular segments at four corners thereof.

4. A core for a deflection yoke according to claim 3, further comprising:

a plurality of separating protruded portions provided separately on the side of said neck portion and the side of said funnel portion, wherein the number of said protruded portions on the side of said funnel portion is different from the number of said protruded portions on the side of said neck portion.

5. A core for a deflection yoke according to claim 3, wherein at least a part of said plurality of protruded portions is non-radially provided.

6. A deflection yoke for a cathode ray tube, comprising:

a core according to claim 3;

a vertical winding disposed along a grooved portion between said protruded portions; and a horizontal winding disposed inside said core.

* * * * *

UNITED STATES PATENT AND TRADEMARK OFFICE

CERTIFICATE OF CORRECTION

PATENT NO. : 6,281,623 B1
DATED : August 28, 2001
INVENTOR(S) : Suzuki et al.

It is certified that error appears in the above-identified patent and that said Letters Patent is hereby corrected as shown below:

Title page,
Item [75], Inventors, should read:

-- [75] Inventors: Hidekazu Suzuki; Kazuyuki Iimura, both of Funabashi; Nobuya Kashiwaba, Narashino; Yukiharu Kinoshita, Honjyo; Shinichiro Ito, Yuri-gun; Hitoshi Iwaya, Honjyo, all of (JP) --

Signed and Sealed this

Thirtieth Day of December, 2003

JAMES E. ROGAN
*Director of the United States Patent and Trademark Office*